US010809006B1

(12) United States Patent
Shah

(10) Patent No.: US 10,809,006 B1
(45) Date of Patent: Oct. 20, 2020

(54) CONDENSER

(71) Applicant: Surendra Himatlal Shah, Mumbai (IN)

(72) Inventor: Surendra Himatlal Shah, Mumbai (IN)

( * ) Notice: Subject to any disclaimer, the term of this patent is extended or adjusted under 35 U.S.C. 154(b) by 0 days.

(21) Appl. No.: 16/584,153

(22) Filed: Sep. 26, 2019

Related U.S. Application Data

(60) Provisional application No. 62/867,214, filed on Jun. 26, 2019.

(30) Foreign Application Priority Data

Jul. 26, 2019 (IN) ..... 201921030201

(51) Int. Cl.

| | |
|---|---|
| ***B01F 3/04*** | (2006.01) |
| ***F28B 7/00*** | (2006.01) |
| ***F28B 11/00*** | (2006.01) |
| *F28B 5/00* | (2006.01) |

(52) U.S. Cl.
CPC ..... *F28B 7/00* (2013.01); *B01F 3/04021* (2013.01); *B01F 3/04078* (2013.01); *F28B 11/00* (2013.01); *F28B 5/00* (2013.01)

(58) Field of Classification Search
CPC ..... B01F 3/04; B01F 3/04021; B01F 3/04078
See application file for complete search history.

(56) References Cited

U.S. PATENT DOCUMENTS 5,209,763 A * 5/1993 Pack ..... B01D 5/0012 95/264

* cited by examiner

*Primary Examiner* — Robert A Hopkins

(57) ABSTRACT

A common method of condensing vapors is to use evaporative condensers that combine the functions of a shell and tube water cooled condenser and a cooling tower into a single unit. This arrangement saves space and eliminates condenser water piping and pumps. They work by spraying water on a horizontal tube bundle and drawing air through it to cool and condense the vapor inside the tubes into liquid. My invention envisages the vapor to be in the shell and air or a mixture of air and water flowing inside the tubes. It works in several different modes, by selectively using the attached modules. This innovative arrangement saves water and energy, while maintaining high thermal efficiency.

10 Claims, 7 Drawing Sheets

CONDENSER

FIELD OF INVENTION

Cross-Reference to Related Applications

Figure 1:
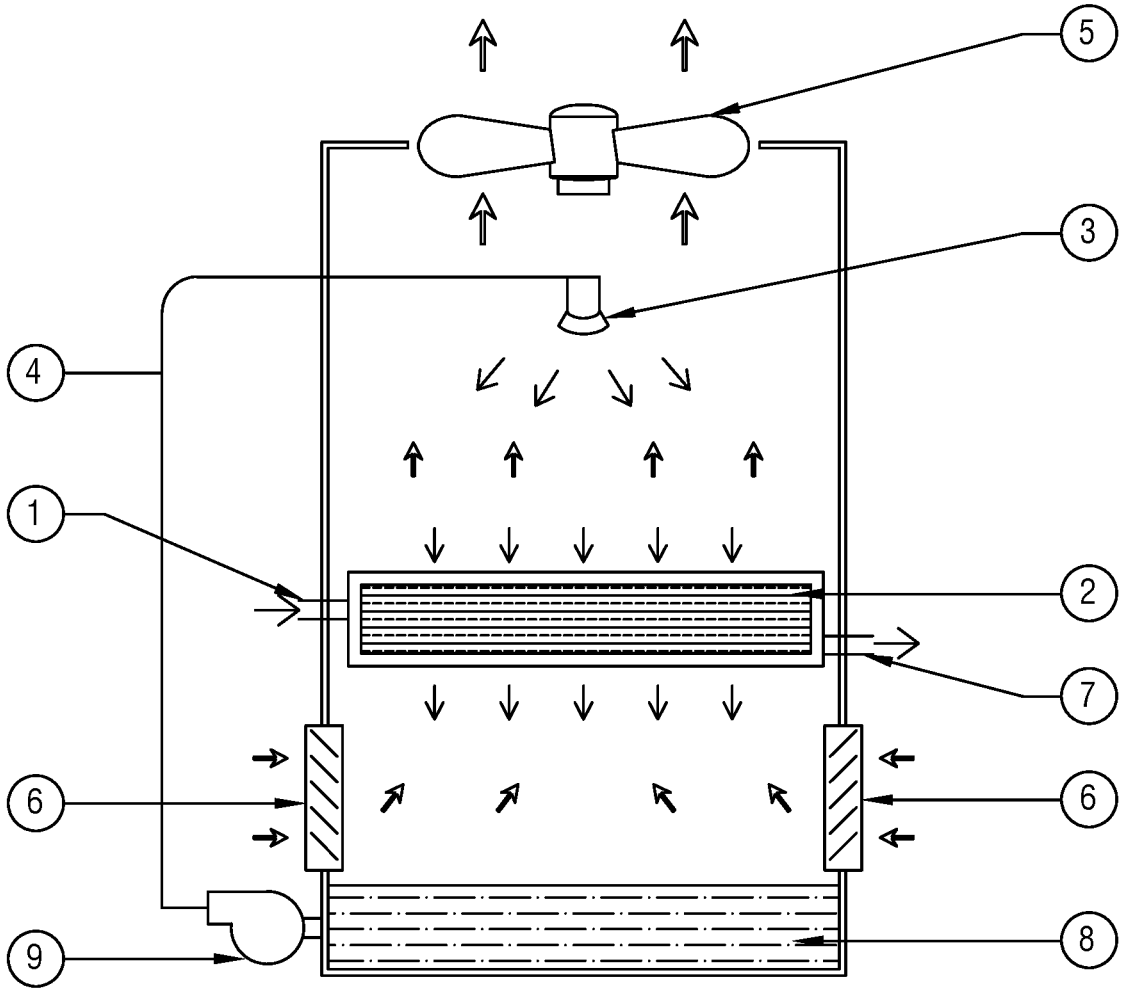

This application claims the benefit of U.S. Patent application No. 62/867,214, filed on Jun. 26, 2019, entitled "A Novel Evaporative Condenser", which is incorporated by reference in its entirety.

BACKGROUND OF THE INVENTION & THE RELATED ART

A. There are three major existing methods of condensing vapors into liquid
   1. By air cooled condensers.
   2. By water cooled condensers needing cooling towers.
   3. By evaporative condensers that do not need cooling towers.

B. The air-cooled condensers have low energy efficiency because of low velocity and low heat absorbing capacity of air.

C. The water-cooled units are more efficient, but they require cooling towers that consume water through evaporation and bleeding to keep the mineral concentration low.

However, the claimed efficiency of the water-cooled system is significant only in the daytime in the summer months, while the water consumption continues throughout the year.

In any case, the loss of water in such large quantities is unacceptable in our water stressed world.

D. Evaporative condensers do not require cooling towers, but they have internal water spray process that consumes the same or more amount of water.

DESCRIPTION OF THE INVENTION

The present invention relates to a Novel Condenser.

FIELD OF THE INVENTION

1. This invention relates to the means of condensing vapors and gases into liquids by extracting heat from them.
2. More specifically it relates to the means of condensing hot vapors into liquids by conducting away their latent heat into a cooling medium such as water or air or both.
3. Even more specifically it relates to an innovative device with multi-mode capability that achieves substantial savings in water consumption by condensers while maintaining high energy efficiency.
4. It also relates to the advantages of a modular approach.

OBJECT OF THE INVENTION

1. The main object of this invention is to achieve a major reduction in the water consumption by the cooling towers, particularly those attached to the condensers of water-cooled vapor condensing systems, while increasing their energy efficiency.
2. The next object is to combine the functions of the cooling tower and the condenser into one unit.
3. The next object is to devise modular arrangement, selectively using various interconnected modules in different combinations in multimode operations that achieve maximum condensation with minimum energy and high recovery of water. The various modes being:— i. Cooling by untreated air only when the ambient air is cool enough.
   ii. Cooling by evaporatively cooled air provided the air cooler module.
   iii. Cooling by atomized and ionized cloud produced by the atomizer unit.
   iv. Cooling by water pumped up from the radiator unit and flowing down from the top of the tube bundle while the air is flowing up, thus causing high turbulence and enhanced heat transfer.
   v. Sealed closed loop operation whereby the mixture of air and water vapor produced in the main module passes through a heat exchanger where a part of the water condenses out. Then the water and the balance mixture are ducted back to the atomizer unit.

STATEMENT OF THE INVENTION a) The prior art condensers have shell and tube design having the vapor in the shell and cooling water flowing through the tubes. The water absorbs the heat from the vapor and is sent to a cooling tower for removing that heat by evaporating some of that water into the air.
b) My invention innovatively combines the two functions of absorbing the heat by water and cooling it by evaporation into the air in a single shell and tube unit. It achieves high cooling efficiency and reduced water consumption.
c) My invention also uses a de-superheating module to reduce the water consumption by reducing the load on the condenser.
d) My invention also uses electrostatically charged atomized fine water particles for enhanced performance.
e) My invention also uses a heat pipe and a hydrophilic de-mister to recover water from the vapor and the mist from the exhaust stream.
f) Another module promotes turbulent mixing and a scrubbing action of the air/water mixture that increases the heat transfer rate through the tube material.
g) The combined effect of these modules working together is a major reduction in the water consumption and an increase in energy efficiency.
h) In one embodiment, the atomizer and the condenser and an air-to-air heat exchanger are interconnected by suitable passages, whereby the air carrying the fog travels to the condenser, where the fog particles evaporate, and the mixture enters the heat exchanger. Here the water condenses, and both the condensed water and the air are led back to the atomizer, resulting in zero loss of air or water.

NOW THE INVENTION IS DESCRIBED WITH THE HELP OF DRAWINGS

FIG. 1: The current prior art system, wherein the vapor is in the tubes and water is sprayed on them. A fan draws air over the tubes, cooling them evaporatively.

Figure 2:
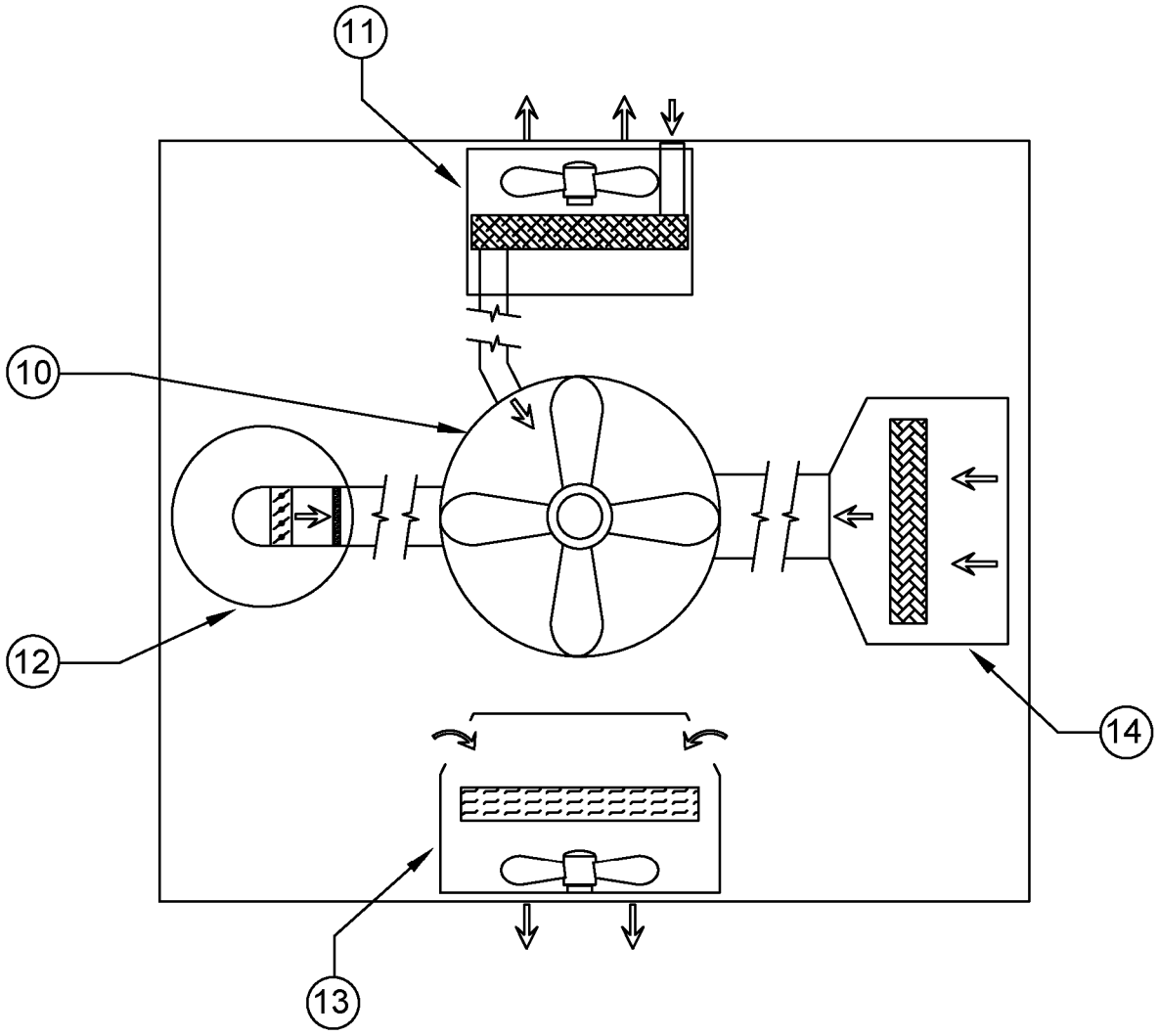

FIG. 2: The modular concept by a plan (an assembly diagram), as an indicative depiction of five modules and their interconnection. They are:—

Figure 7:
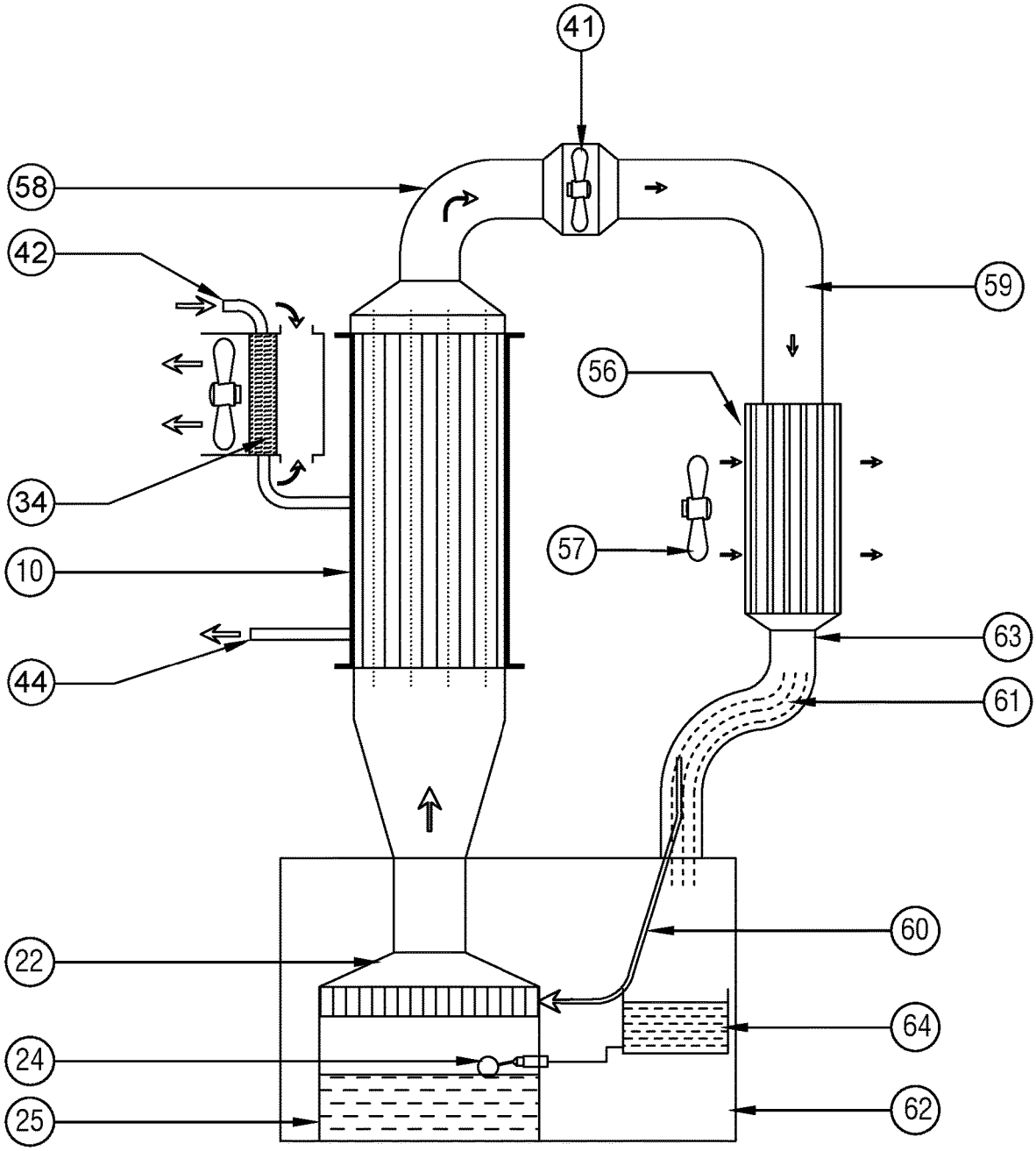

1. The Main Module
2. The Vapor Entry Module
3. The Air Atomizer Module
4. The Radiator Module 5. The Evaporative Cooler Module
6. The Recovery Module is a combination of some items (Items shown in FIGS. 4 & 7)

Figure 3:
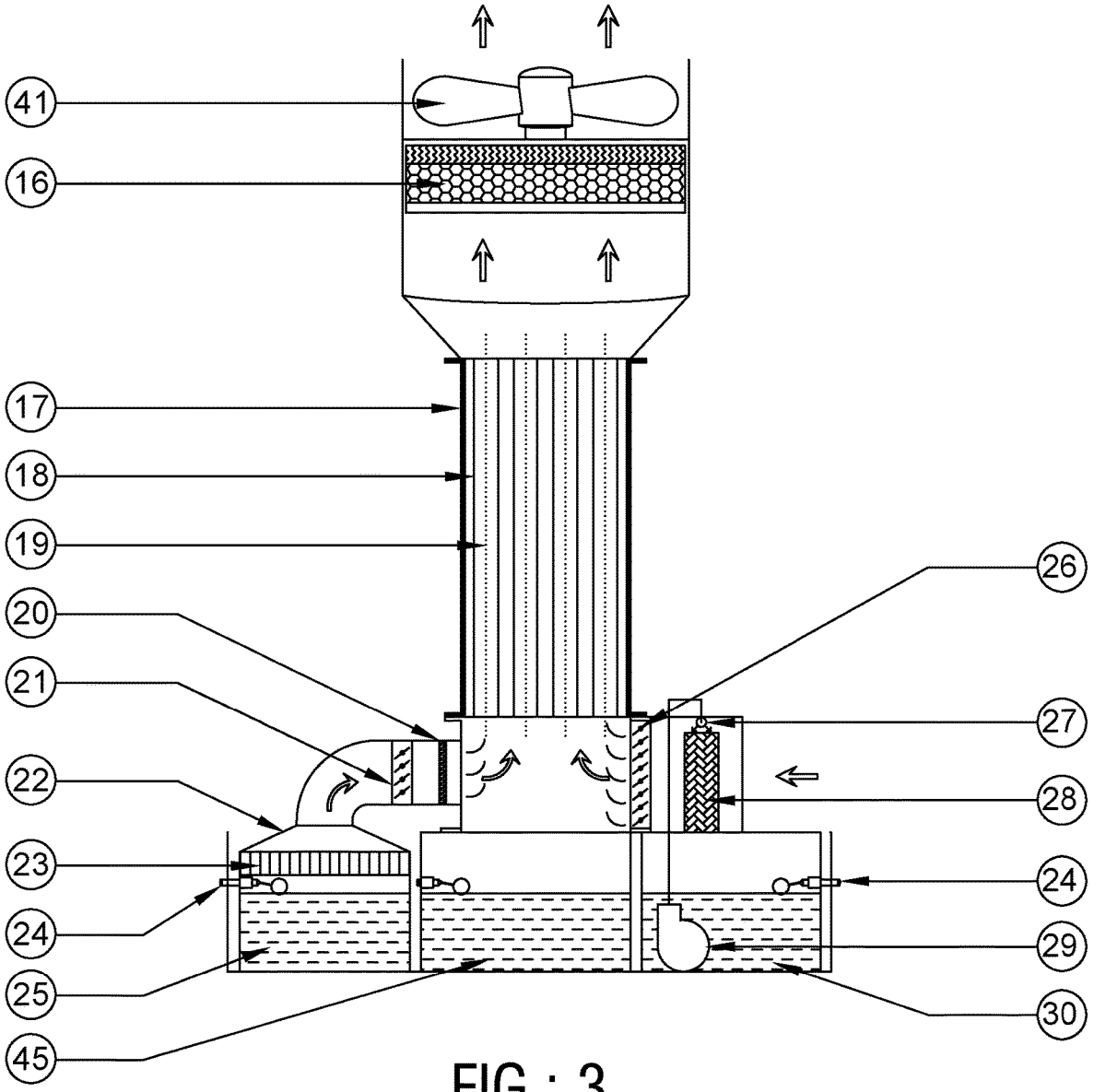

FIG. 3: A sectional view, showing the Atomizer Module and the Evaporative Cooler Module as connected to the main Module.

Figure 4:
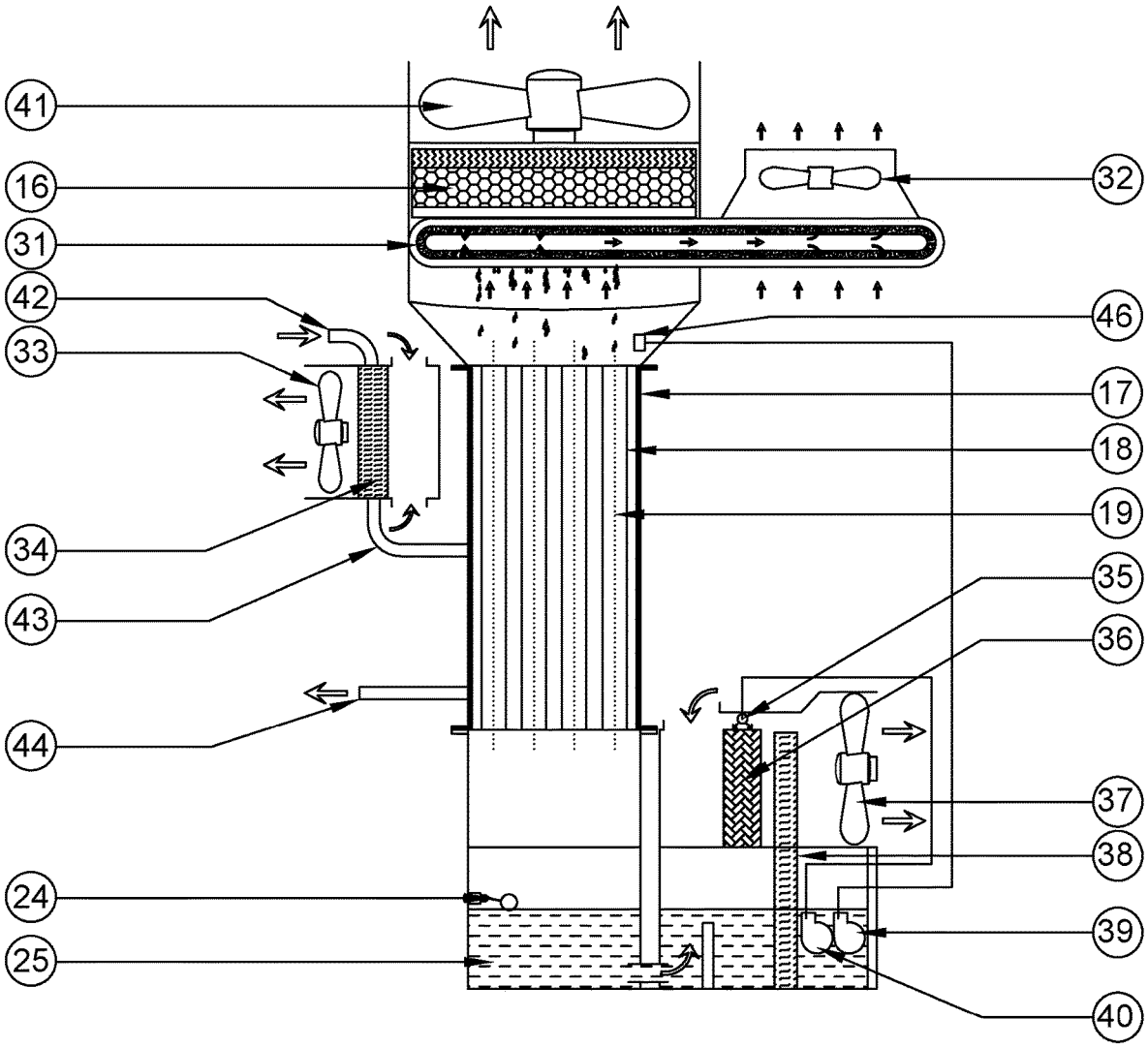

FIG. 4: Another sectional view showing the Vapor Entry Module and the Radiator module with the Recovery elements at the top.

Figure 5:
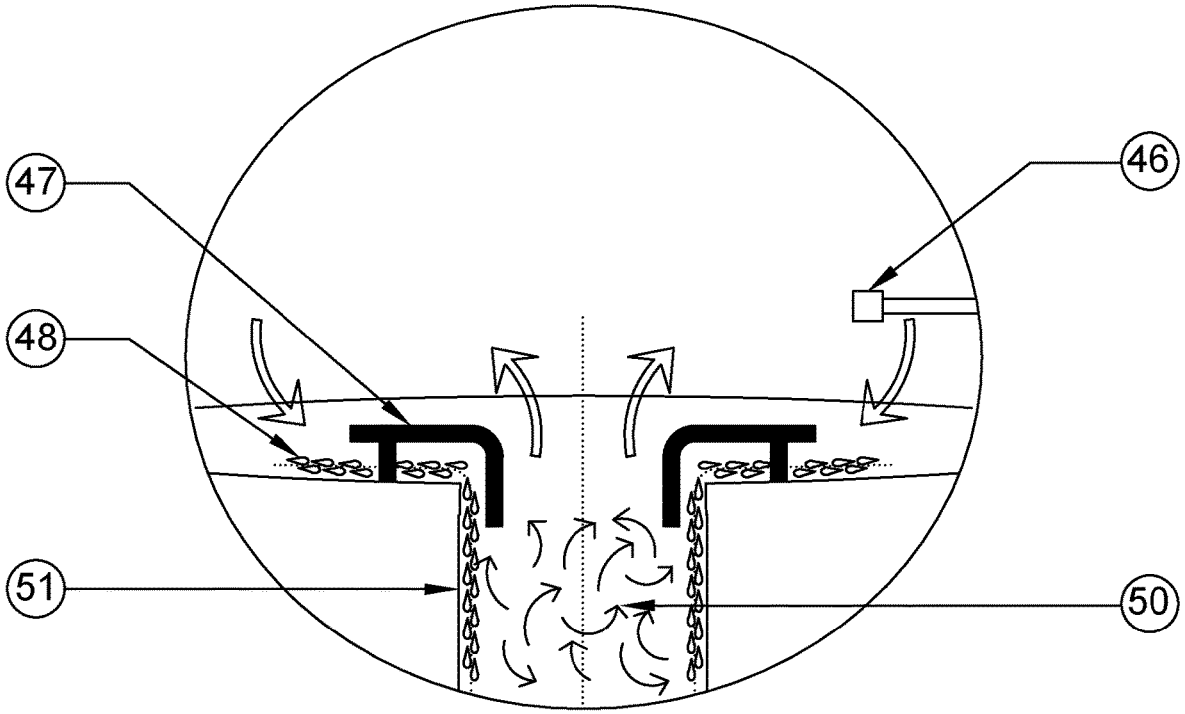

FIG. 5: The action of the spacer that allows the water to flow into the tube by gravity, despite the high velocity updraft.

Figure 6:
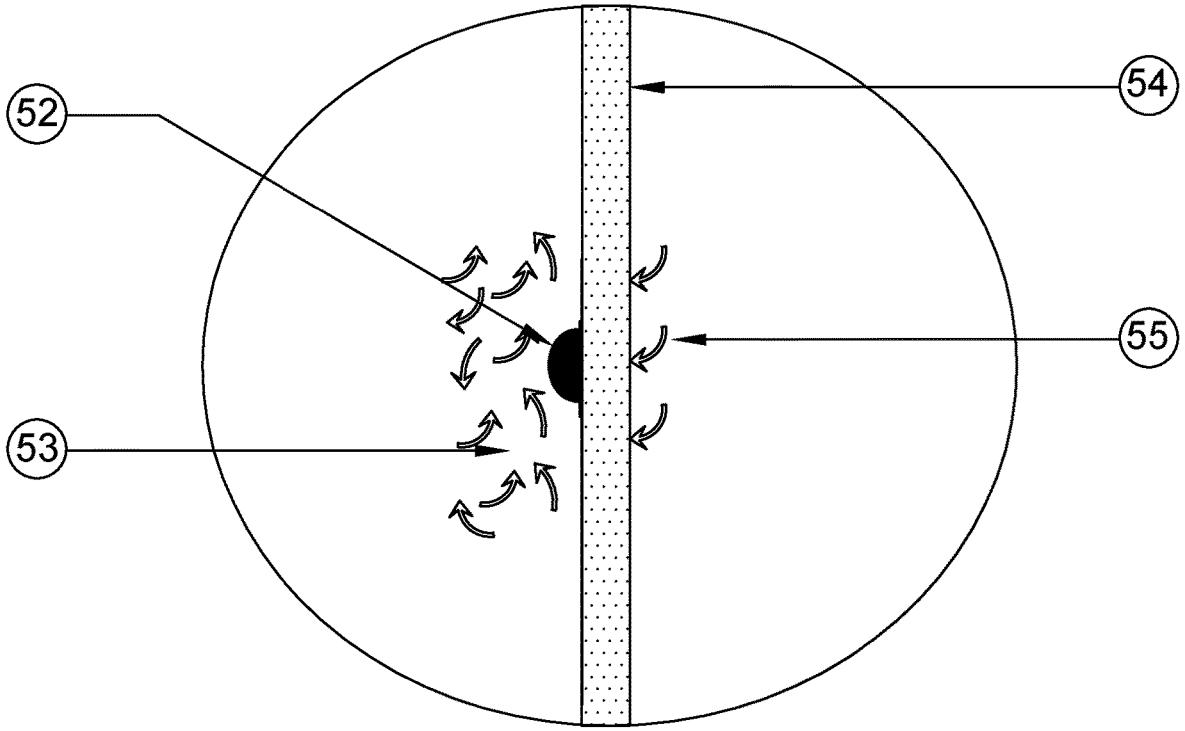

FIG. 6: An expanded view of the scrubbing action of the turbulent air flow and the fast evaporating small droplet enhancing the heat transfer across the tube wall FIG. 7: The closed Loop Embodiment.

FIGURE POINTS DESCRIPTION

1. Vapor Inlet
2. Condenser Coil
3. Spray Nozzle
4. Water Pipe
5. Fan
6. Air Inlet Louvers
7. Condensed Liquid Out
8. Water Tank
9. Water Pump
10. Main Module
11. Vapor Entry Module
12. Air atomizer Module
13. Radiator Module
14. Evaporative Cooler Module
15. Recovery Module (Shown in FIG. 4)
16. Hydrophilic Pad
17. Shell
18. Tubes
19. Tubes
20. Ionizer
21. Open Damper
22. Automizer Module
23. Grille
24. Makeup Water Valve
25. Tank
26. Damper
27. Tap
28. Pad
29. Pump
30. Tank
31. Heat Pipe Water Vapor Recovery Unit
32. Fan
33. Fan
34. Coil
35. Vapor entry point
36. Cooling Pads
37. Fan
38. Heat Pipe
39. Pump
40. Pump
41. Draft Fan
42. Coil Entry
43. Cooled Vapor Entry Pipe
44. Exit
45. Tank
46. Top
47. Spacer
48. Water
49. Mixing of Two Fluids
50. Tube
51. Small Droplets
52. Vapor
53. Evaporation of water
54. The Other Side
55. Condensation
56. Heat Exchanger
57. Fan
58, 59, 60, 61. Ducts
62. Return Chamber
63. Duct
64. Tank

GENERAL DESCRIPTION OF PRIOR ART WITH THE HELP OF FIG. 1

Referring to the FIG. 1 the current design in existence working is described.

The vapor to be condensed (1), enters a horizontal coil (2). The nozzle (3), sprays the cooling water on the coil (2) from pipe (4). Simultaneously, the fan (5), draws air in from the louvers (6) that passes through the coil (2) before being exhausted into the atmosphere. The air evaporates the water covering the tubes of the coil (2). The heat for the evaporation is drawn from the vapor (1) by conduction through the tubes of the coil (2). Thus the condensing vapor (1) into a liquid that then exits through the nozzle (7). The water is then collected in a tank (8). A pump (9) sends it back to the nozzle (3) via the pipe (4).

DETAILED DESCRIPTION OF THE INVENTION UNDER CONSIDERATION WITH THE HELP OF FIGS. 2 TO 6

1. For achieving the stated Objects of the invention, the invention has adopted the modular concept by using at least six stated modules that work singly or in combinations that work as an innovative evaporative condenser where the vapor is in the shell and the tubes are cooled by just the air or an air/water mixture.
2. Full Load Operation. Refer to FIG. 3

The Atomizer Module, which is the main workhorse, draws water from the tank (25), atomizes it, mixes it with the ambient air drawn from the grille (23) and supplies it into the main module after passing through the damper (21) and the Ionizer (20). This cloud of ionized water particles and air is drawn up through the tubes by an induced draft fan (41). On the way up, the charged water particles are quickly and strongly attracted to the tube (19)'s inner surface. Being small, the droplets evaporate almost as soon as they touch it. The electrostatic charge causes the particles to quickly cover any dry space as soon as it appears. With proper design of the flow rates and particle size control, almost all the water would evaporate. Unattached particles are absorbed by the hydrophilic pad (16). Thus, any drift losses are eliminated. The shell side performance is described in a later section. The damper (26) is closed, so no air would enter from the Evaporative Cooling Module.
3. Partial Load Operation During periods when the load is not at its peak or if the ambient air is cooler, the Atomizer Module is shut off and is isolated. The Evaporative Cooler Module is activated and the fan (41) draws cool air through the pad (28) via tap (27), wetted by the pump (29) from tank (30). The cool humid air cools the tubes of the Main Module by contact, thus causing the vapors in the shell to condense. The heat transfer in the in the Main Module is sensible only. The water consumed by the pad (28) is by the heat of the ambient air only, which is much less than that by the atomizer. This results in reduced energy and water consumption.

4. Minimum Load Operation

In FIG. 3, the tanks (25) and (30) of Evaporative Cooling Module are empty and the makeup line (24) is shut off. In operation the fan (41) draws the ambient air through the dry pad and enters the Main Module via the open damper (26). It then cools the tube bundle on the way up, thus causing condensation on the other side.

a. Ambient air is also supplied into the Main Module by the Atomizer module (22) through the open damper (21), while the Atomizer itself is turned off.

b. Operation in this mode is possible when the ambient temperature, which is also the cooling air temperature, is several degrees lower than that at which the vapor condenses. In this mode, the tank (25), is empty, while the makeup water valve (24) and the pump (29) are shut off. The cooling is done only by air, thus saving 100% of the water.

5. Load reduction and water recovery. Refer to FIG. 4.

a. The Vapor Entry Module (Item 11, FIG. 2) is a de-super heater device comprising a coil (34) that is cooled by the ambient air drawn through it by the fan 33. The vapor is thus partially cooled and the resulting reduction of the load on the Main Module results in reduced water consumption there. The hot vapor enters the coil at (42) and the cooled vapor enters the Main Module at (43).

b. The heat pipe water vapor recovery unit (31) cools the vapor generated inside the tubes (19) as it passes through the top of the main module by carrying its heat to the other end where a fan (32), draws it out to the atmosphere. This recovers the water that is otherwise lost and forms the "plume" of a cooling tower.

c. The hydrophilic pad (16) absorbs and returns any water particles that might float up.

6. An alternate system 1. Refer to FIGS. 3, 4 & 5.

a. The idea is to establish a counter current interaction between the air going up and the water flowing down inside the tubes 18, while the vapor is in the shell (17).

b. At high air velocity, there will be a turbulent mixing of the two fluids (49), water will break up into small droplets that will scrub the inside walls of the tubes.

c. This action will remove the surface film and promote fast heat transfer, resulting in quick evaporation of fine droplets, thus improving the efficiency of the process.

d. This works by the pump (39) taking water from the tank (25) and releasing it at the top (46).

e. From here the water falls by gravity inside the tubes (19) and meets the air coming up the same tube.

f. The un-evaporated water falls back into the tank (45).

g. Being hot, it is cooled by the radiator module comprising a pump (40), a heat pipe (380, a cooling pad (36) and a fan (37) before the pump (39) takes it up.

h. The Valve (24) admits make up water for maintaining the required level.

i. The spacer (47) shields the water (48) as it flows down the tube (50) while allowing the air/vapor mixture to exit at a high velocity.

j. The FIG. 6 shows how a small droplet (51) can evaporate quickly into vapor (52) causing condensation (54) on the other side (53).

7. An alternate system 2. The Closed Loop Embodiment. Refer to FIGS. 7A & 7B.

a. This version is a sealed closed loop circuit where the air output instead of being released in the atmosphere, is ducted back to the inlet grill. Therefor there is zero loss of air and vapor.

b. The return chamber (1) consists of a water tank (2) and a fog machine (3) and a float valve (4).

c. The fog machine (3) draws air and water from the return chamber (1) to create fog that is a mix of fine water particles and air.

d. The mix exits the return chamber (1) at (5) and enters the inlet chamber (6) of the condenser (8).

e. Within the condenser, the fog particles absorb heat from the incoming hot vapor (7) and convert to water vapor. The incoming hot vapor condenses into liquid and leaves the coil at (18).

f. The water vapor along with the air is then drawn by the fan (9), through a duct (10) into the hot side (11) of the air to air heat exchanger (12).

g. The ambient air enters the cold side (13) of the same heat exchanger (12) at (14).

h. While passing through the hot side (11), the vapor condenses by giving up its heat to the cold side (13).

i. The cold air heats up and is exhausted by fan (15) at (16) to the atmosphere.

j. From the hot side, the condensed vapor returns to the tank (2) via the float valve (4), and then to the fog machine (3) at (17).

k. The air returns to the fog machine (3) via the inlet chamber (1) also at (17).

Principle-to-Practical

In the above narration, skeleton sketches and single element construction were used to state the principle of operation of the invention. In actual practice, there would be many embodiments.

1. The term "tube" also covers a group of tubes of varying quantity, material and shape as required for efficient operation.
2. The tube material can be metal, ceramic, plastic or any other material that has the required thermal, physical and chemical resistance properties.
3. The shape can be round, oval, hexagonal etc. Lengthwise the tube can be straight or coiled or serpentine or any other shape as required by the designer.
4. The "shell" and "tube" can also be alternate elements in a plate type heat exchanger acting as an evaporative condenser.
5. The term "vapor" includes refrigerants, vapor from chemical or biochemical processes or even spent low temperature steam from power plant turbines.
6. Some components can be merged or modified due to practical constraints. For example, the atomizer and the ionizer could be incorporated in one single unit.
7. The system can be applied to cool any hot vapor or liquid or gas.

Advantages of the Invention

These inventive steps in the invention under consideration, promote energy efficiency and substantial saving in water consumption. The steps are as follows:

1. The major advantage will come from the elimination of the water-cooled condenser, the pumps, the piping and the cooling tower itself, resulting in significant savings in water and energy consumption.

2. Next advantage is due to the use the Atomizer/Ionizer, since the negatively charged, low mass water droplets will move fast and quickly evaporate when they attach themselves to the tube wall.
3. The turbulent counter current mixing of the water and the air that creates a mist of fine water droplets scrub the tube surface. This action allows them to touch the tube surface directly, allowing fast evaporation due to their small size, thus low mass.
4. A properly designed heat pipe water recovery could recover a larger portion of the vapor now lost with the exhaust air.
5. If the passive heat pipes were to be replaced by an active heat pump, it could convert most the energy from the condensing vapor into high temperature heat source.
6. The hydrophilic mist catcher captures any water particle that touches it while, the air-mist mixture is passing through its convoluted passages, absorbs it and returns it. This reduces the "windage" loss of water.
7. The Multimode Operation. By proper thermal design, the number of tubes in the condenser can be adjusted so that it can work without the water when either the cooling load or the ambient air temperature is low. Since there are daily and yearly swings in the cooling load and the ambient, it is possible to achieve very substantial saving in water consumption while maintaining high energy efficiency.

INDUSTRIAL APPLICATIONS

The industry can benefit in various way with the use of the invention under consideration:

1. To convert air cooled HVAC systems into the system under consideration for increasing efficiency while using very little water.
2. To convert water cooled systems by eliminating the cooling towers, thus saving huge quantity of water.
3. To use the high temperature energy recovered by the heat pump for heating.
4. To incorporate the system under consideration, while designing the new projects for maximum benefits in energy, water and space.
5. To save 100% of the water by using the closed loop embodiment.

I claim:

1. A modular condenser system, the system comprising:
a main module including a shell;
a plurality of vertically oriented tubes within the shell;
a hydrophilic pad above the vertically oriented tubes;
an uppermost induced draft fan; and
a plurality of modules in fluid communication with the main module, wherein each of the plurality of modules is capable of functioning individually with the main module or as a combination of two or more of the plurality of modules together with the main module,
wherein the plurality of modules is selected from the group consisting of: a vapor entry module, an atomizer and ionization module, a radiator module, and an evaporative cooler module.

2. The system of claim 1, wherein the plurality of modules includes the atomizer and ionization module, and the atomizer and ionization module comprises:
an ionizer that is in fluid communication with the shell; and
a tank containing water,
wherein the induced draft fan causes water droplets to be drawn from the tank and through the ionizer, and the ionizer charges the water droplets.

3. The system of claim 2, wherein the atomizer and ionization module further comprises a grill, wherein ambient air is drawn through the grill by the induced draft fan, so that the ambient air mixes with the air droplets.

4. The system of claim 1, wherein the plurality of modules includes the evaporative cooler module, wherein the evaporative cooler module is in fluid communication with the shell, and the evaporative cooler module comprises:
an evaporative pad;
a tank containing water; and
a pump,
wherein the pump circulates the water from the tank to the evaporative pad, and the induced draft fan draws ambient air over a surface of the evaporative pad, and into the shell.

5. The system of claim 1, wherein the plurality of modules includes the vapor entry module, wherein the vapor entry module is in fluid communication with the shell, and the vapor entry module comprises:
a coil; and
a vapor module fan,
wherein the induced draft fan draws ambient air through the coil, and the vapor module fan blows air onto the coil, to cool the ambient air inside the coil.

6. The system of claim 1, further comprising:
a tank containing water; and
a pump in fluid communication with the tank and the shell,
wherein the pump pumps water from the tank to a point in the shell that is above the tubes and below the hydrophilic pad.

7. The system of claim 6, wherein the plurality of modules includes the radiator module, wherein the radiator module comprises:
a radiator pipe;
a second pump, wherein the second pump is in fluid communication with the tank;
a cooling pad; and
a radiator fan;
wherein the water in the tank enters the radiator pipe, and the second pump circulates water through the cooling pad, and the radiator fan blows ambient air onto the cooling pad and the radiator, to cool the water within the radiator.

8. The system of claim 1, further comprising a vapor recovery unit that is in fluid communication with the shell at a point between an upper end of the vertical tubes and the hydrophilic pad, wherein the vapor recovery unit comprises a housing and a fan, so that vapor exiting the vertical tubes enters the housing and is cooled by the fan.

9. A modular condenser system, the system comprising:
a main module including a shell;
a plurality of vertically oriented tubes within the shell;
an uppermost induced draft fan; and
a plurality of modules in fluid communication with the main module, wherein each of the plurality of modules is capable of functioning individually with the main module or as a combination of two or more of the plurality of modules together with the main module, wherein the plurality of modules consists essentially of: a vapor entry module, an atomizer and ionization module, a radiator module, and an evaporative cooler module.

10. The system of claim 9, further comprising:

a secondary condenser;

a secondary condenser fan;

a water reconditioning tank; and a plurality of air ducts, wherein a first of the plurality of air ducts connects the shell to the secondary condenser, and a second of the plurality of air ducts connects the condenser to the water reconditioning tank, and wherein the uppermost induced draft fan is within the first of the plurality of air ducts, wherein the uppermost induced draft fan draws vapor from the top of the tubes into the first of the plurality of air ducts and into the condenser, so that the vapor is cooled at least partially into liquid water, wherein the liquid water passes through the second of the plurality of air ducts and into the water reconditioning tank.

* * * * *